United States Patent [19]

Krolak

[11] 4,204,740

[45] May 27, 1980

[54] CONNECTOR COUPLING RING RETAINER APPARATUS AND ELECTRICAL CONNECTOR ASSEMBLY RETAINING MEANS

[75] Inventor: Ronald F. Krolak, North Riverside, Ill.

[73] Assignee: Bunker Ramo Corporation, Oak Brook, Ill.

[21] Appl. No.: 745,765

[22] Filed: Nov. 29, 1976

Related U.S. Application Data

[63] Continuation of Ser. No. 453,674, Mar. 22, 1974, abandoned, which is a continuation-in-part of Ser. No. 271,352, Jul. 13, 1972, abandoned.

[51] Int. Cl.[2] ..... H01R 13/54

[52] U.S. Cl. ..... 339/90 R

[58] Field of Search ..... 85/8.8; 285/300, 328, 285/361, 381, DIG. 22; 339/89 R, 89 C, 89 M, 90 R, 90 C, 90 F, 94 R, 94 A, 94 C, 94 L, 94 M, 140 R, 140 C, 140 S, 59 R, 59 LM

[56] References Cited

U.S. PATENT DOCUMENTS

| | | | |
|---|---|---|---|
| 2,563,762 | 8/1951 | Uline | 339/89 M |
| 3,054,981 | 9/1962 | Malek | 339/89 C |
| 3,125,395 | 3/1964 | Swanson | 339/63 M |
| 3,336,569 | 8/1967 | Nava | 339/94 M |
| 3,386,347 | 6/1968 | Bachle | 85/8.8 |
| 3,818,420 | 6/1974 | Barr | 339/94 R |

*Primary Examiner*—Joseph H. McGlynn
*Attorney, Agent, or Firm*—F. M. Arbuckle; R. N. Muehleman

[57] ABSTRACT

This invention relates to an electrical connector assembly including apparatus for securing a metallic coupling ring on a connector body or shell. A metallic retaining ring is secured into the rear of the coupling ring bore through the interaction of an annular sawtooth groove pattern formed on the outside of the retaining ring and on the rear inside of the coupling ring bore. The dimensions of the sawtooth groove pattern are carefully selected so as to permit metallic materials to be used for both rings. The connector assembly includes a pair of shells, each having electrical contacts carried by a dielectric retention disc secured in a respective shell for engagement with the electrical contacts of the other shell. Each shell has a large diameter recess for receiving a large diameter portion of each disc force fit through a small diameter portion of the respective shell to thereafter retain the disc. The shell small diameter portion is bounded by a conical camming surface and a conical camming surface is formed adjacent the front end of the disc enlarged diameter portion for enabling force fitting each retention disc through the small diameter portion of the respective shell. Circumferentially spaced ribs on the disc surface also engage the shell wall to prevent disc shifting.

20 Claims, 9 Drawing Figures

Fig. 1
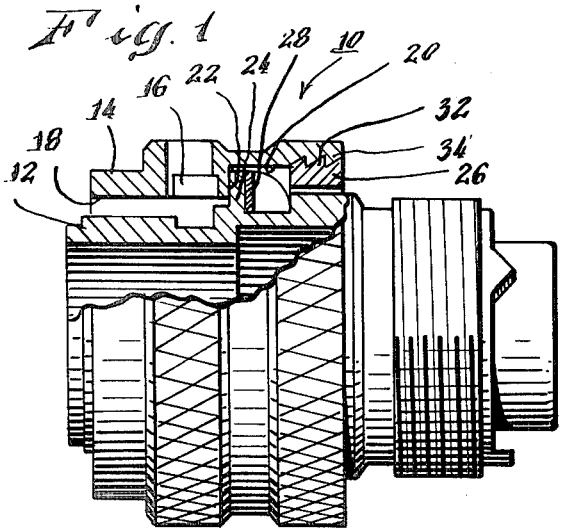
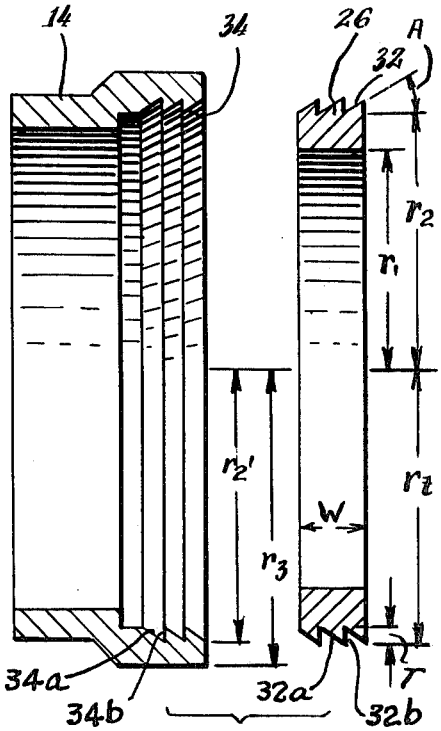
Fig. 2A.
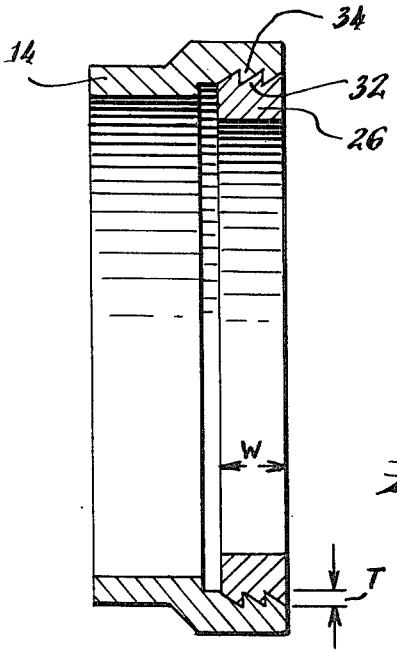
Fig. 2B.
Fig. 3A.
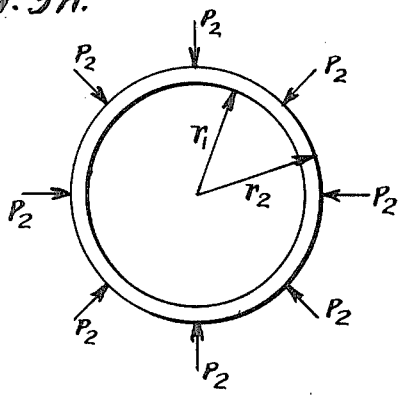
Fig. 3B.
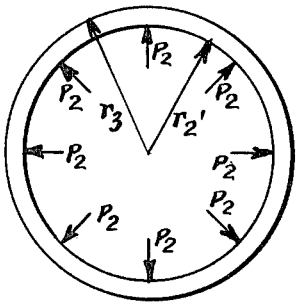

CONNECTOR COUPLING RING RETAINER APPARATUS AND ELECTRICAL CONNECTOR ASSEMBLY RETAINING MEANS

FIELD OF THE INVENTION

This is a continuation of application Ser. No. 453,674 filed Mar. 22, 1974 (now abandoned) which is a continuation-in-part application of application Ser. No. 271,352 filed July 13, 1972, now abandoned and the invention relates in general to apparatus for retaining the coupling ring of a connector on the connector body and more particularly to an improved and more economical electrical connector assembly.

SUMMARY OF THE PRIOR ART

In electrical connector assemblies, one of the elements frequently has a coupling ring mounted on the connector body. The ring usually has a thread or cam track, which is adapted to mate with a corresponding thread or bayonet pin on the mating element when the coupling ring is rotated to secure the two connector elements or shells together. The coupling ring must thus be mounted both for rotation and axial movement on the connector body.

In assembling a connector element of the type indicated above, present practice is to insert the front of one connector body or shell into a bore in the rear of the coupling ring until a projection on the body butts against a shoulder in the bore. A retainer ring is then fitted into the rear of the coupling ring bore and secured therein. The retainer ring butts against the other side of the body projection when the coupling ring is moved to a forward position preventing the coupling ring from being removed from the body. The retaining ring is secured to the coupling ring either by being screwed therein, a screw thread on the outside of the retainer ring mating with a screw thread at the rear of the coupling ring bore, or the two rings are held together by a C ring which, when the coupling and retaining rings are together, rides partly in an annular groove of each member.

Each of the above-indicated means for securing the retaining ring to the coupling ring has some disadvantages. Screw threads are expensive to form, requiring a time-consuming threading operation. Screw threads may also come loose in use. The C ring introduces an extra part into the connector assembly and thus increases both the cost of material and the cost of assembly.

One technique presently employed in some applications to reduce the cost of securing the coupling and retaining rings of a connector is to utilize a retainer ring of a rubber or plastic compound with an annular sawtooth groove pattern formed on its periphery. Such a retaining ring may be snap-fitted with a mating groove pattern in the rear of the coupling ring bore. Since the plastic part may be moulded in any desired pattern, or, if necessary, a sawtooth groove pattern may be formed during a single revolution on a turning machine, these retaining rings are faster, easier and less expensive to fabricate than a screwthreaded ring. The sawtooth pattern also provides positive locking and permits the rings to be secured without the need for additional components. However, at elevated temperatures, such as for example 200° C., at which connectors are frequently required to operate, the type of plastic material used becomes soft and is no longer capable of providing the desired positive retention. This technique for securing the coupling and retaining ring thus has limited application. On the other hand, utilizing metallic coupling and retaining rings with an interlocking sawtooth configuration does not appear as a feasible alternative in view of the relatively large wall thickness of the rings, short coupling length and relatively small radius.

From the above, it is apparent that a need exists for a simple, inexpensive technique for securing the retaining ring of a connector to the connector coupling ring. This coupling technique should preferably not require the introduction of additional components and should be adapted for providing positive retention even at elevated temperatures.

In an electrical connector assembly, the coupling ring is mounted for limited axial movement on one annular metal shell carrying a plurality of contacts. The shell has a front end engaging the front end of another annular metal shell carrying another plurality of contacts to bring the contacts in one shell into engagement with respective contacts of the other shell. The shells are secured to each other by the coupling ring under spring tension to retain the shells and contacts engaged.

The contacts in each shell are located in passageways in a pair of axially adjacent dielectric members commonly called a retention disc and front insert respectively. The retention discs and inserts must be secured against axial or other movement in each shell and, of course, must be properly oriented in order to assure alignment of the contacts.

In order to retain the dielectric members in the shells, the periphery of the retention discs are provided with moulded tines, which require that thin undercut portions be formed in the periphery of the disc to define the tines, which are also relatively thin. This arrangement not only creates considerable mould flash, but results in moulds which are short-lived, complicated, expensive and difficult to maintain.

SUMMARY OF THE INVENTION

In accordance with the above, this invention provides a connector element or assembly which includes a connector body and a coupling ring of a metallic material mounted on the body. The coupling rig has an internal bore dimensioned to fit on the body and an enlarged rear counterbore, an annular sawtooth groove pattern being formed at the rear end of the counterbore. The final element of the connector is a retainer ring of a metallic material. The retainer ring has formed around its outer surface an annular sawtooth groove pattern dimensioned to interfit or interlock with the groove pattern in the coupling ring. The groove patterns or teeth are each angled at one face to permit the retaining ring to be pressed into the coupling ring but to prevent the rings from being separated, the other face of the patterns of teeth are arranged as stop faces substantially perpendicular to the respective ring axis to thereafter prevent retraction of the retaining ring from the coupling ring.

The dimensions of the groove patterns on the rings are selected so that they permit taking advantage of the elastic displacement of the rings when the groove patterns are moved axially past each other without excessively deforming the patterns or excessively stressing the rings. It has, therefore, been discovered that the groove patterns will pass over each other, in response to axial pressure, despite the stiffness of the rings, while providing a tight fit between the groove patterns with the rings in fully mated condition to prevent separation of the rings.

The shells, which carry the retention discs, front inserts and engaging contacts, each have a large diameter recess formed in the inner surface thereof and intermediate the ends of each shell. A small diameter surface portion forming a stop or shoulder substantially perpendicular to the shell axis is formed at the rear of each recess and a conical camming surface portion extending radially outwardly and axially rearwardly is formed at the rear of the small diameter portion.

The retention disc for each shell is provided with an enlarged outer diameter periphery corresponding to the shell recess diameter and the disc is force fit through the shell small diameter portion with the aid of the shell camming surface and a similarly shaped disc conical camming surface portion in front of the enlarged diameter disc portion to bring the large diameter portion of the disc into engagement with the shell recess. A face perpendicular to the axis of the disc at the rear end of the disc engages against the shoulder perpendicular to the shell axis formed at the rear end of the shell recess to thereafter hold the disc against retraction from the shell.

The disc conical camming surface portion and shell conical surface portion provide cam action to aid in elastically deforming the shell and disc, which is relatively thick and has a continuous radial web, for movement through the shell. With this arrangement, the afore-described disc tines together with their disadvantages are avoided and an extremely simple, effective and economical assembly is provided.

A plurality of longitudinally axially extending ribs are also integrally formed on the disc adjacent the radially inward end of each disc conical surface to engage against the correspondig end portions of the shell recess wall. The ribs maintain the disc properly seated and oriented against sideward shifting or cocking of the disc, since such shifting presents a problem due to dimensional or other variations between the materials.

It is, therefore, a primary object of the present invention to provide an improved and more economical electrical connector assembly.

The foregoing and other objects, features and advantages of the invention will be apparent from the following more particular description of a preferred embodiment of the invention as illustrated in the accompanying drawings.

BRIEF DESCRIPTION OF THE DRAWINGS

FIG. 1 is a partially cut-away side view of a connector element utilizing the coupling ring retention technique of this invention.

FIGS. 2A and 2B are enlarged partially cut-away side views of the coupling and retaining rings of this invention, showing the rings in an unmated and mated condition respectively.

FIGS. 3A and 3B are back views of the retainer ring and the coupling ring respectively illustrating the direction of the pressure forces applied thereto when they are pressed together.

DETAILED DESCRIPTION

Figure 4:
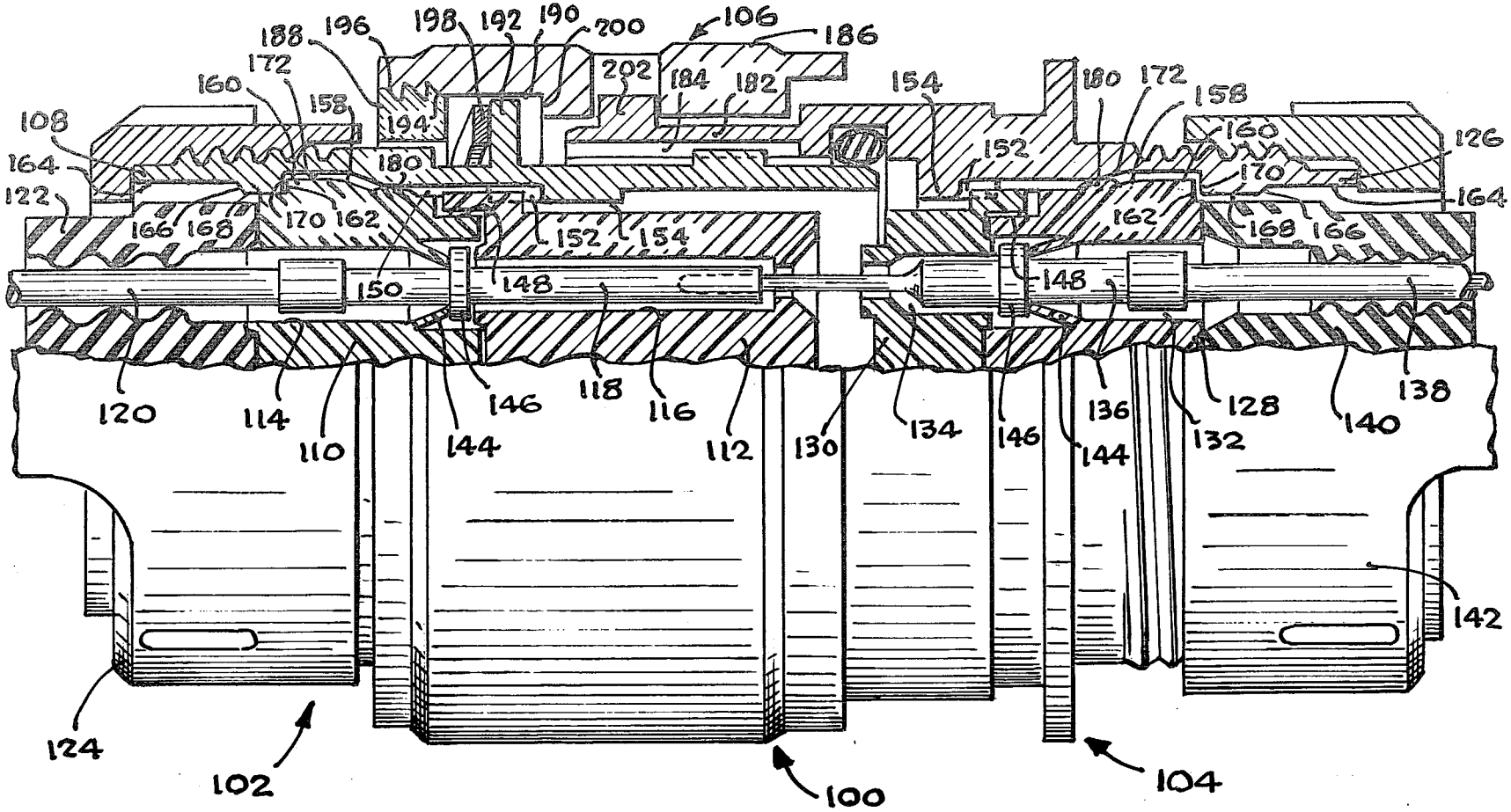
FIG. 4 is a side elevational view partially in section illustrating an electrical connector assembly incorporating the principles of the present invention.

Referring now to FIG. 1, it is seen that the connector 10 has as its main element a body or shell 12. Within shell 12 may be electrical contacts and insulators or other elements of standard construction. Since the elements within the body do not form part of the present invention shown in FIGS. 1, 2A and 2B, there will be no further discussion of these elements with reference to the invention shown in FIGS. 1, 2A and 2B. A coupling ring 14 shown in FIG. 1 as having a cam track or means 16 to secure the ring to another shell is mounted for rotation and axial movement on body 12. Coupling ring 14 has a bore 18 and an enlarged counterbore 20 with a shoulder 22 being formed at their junction. Shoulder 22 butts against one side of a flange or projection 24 on shell 12 to limit the movement of the coupling ring relative to the shell in one axial direction of the shell 12. A retaining ring 26 is secured in the rear of counterbore 20 in a mannner to be described shortly and coacts with the other side of shoulder 24 to limit the movement of the coupling ring in the other axial direction of the shell 12. Both the coupling and the retaining rings are formed of a metallic material such as aluminum. A wave washer 28 is provided for spring loading the coupling ring.

To assemble the connector shown in FIG. 1, the one portion of connector shell or body 12 is initially passed through counterbore 20 and bore 18 until projection 24 comes to rest against shoulder 22. Retainer ring 26 is then brought into position behind coupling ring 14. If there is a long cable or hose behind connector body 12, it will be necessary to mount retaining ring 26 on the cable or hose before the coupling ring is put into place. The relative positions of the coupling and retaining rings just prior to assembly is shown in FIG. 2A. Pressure is then exerted on the front of the coupling ring and on the rear of the retaining ring, forcing retaining ring 26 into the back end of counterbore 20. It is noted that, as best seen in FIG. 2A, retainer ring 26 has a plurality of successive annular sawtooth groove patterns or closed ring teeth 32 formed around its outer surface with each groove pattern or tooth 32 defined by a closed annular radially inwardly and axially extending camming portion or conical front camming face **32*a* and a closed annular rear or stop face 32*b* extending radially outwardly substantially perpendicular to the axis of ring 26. It will be noted that face 32*b* extends from an inner radius or diameter definig the retaining ring body to an outer edge joined to face 32*a* and defining the tooth outer radius or diameter which is substantially equal to the inner radius or diameter of the coupling ring body. The rear end of counterbore 20 has a closed annular wall on which a plurality of successive closed annular sawtooth groove patterns or teeth 34 mating with teeth 32 and formed along the inner periphery or surface of the coupling ring annular wall with each groove pattern or tooth 34 defined by a closed annular rear radially inwardly and axially extending camming portion or conical camming face 34*a* and a closed annular rear or stop face 34*b* extending radially outwardly substantially perpendicular to the axis of ring 26. It will be noted that face 34*b* extends from an outer radius or diameter defining the coupling ring body to an inner edge joined to face 34*a* and defining the tooth inner diameter and substantially equal to the outer diameter of the retaining ring body so that the inner and outer radius of each tooth on the coupling ring is coincident and equal with the inner and outer radius respectively of each tooth on the retaining ring. When the retaining ring is forced into the coupling ring, these groove patterns mate and lock together with the faces 32b and 34b engaged to provide a permanent assembly, and when the coupling ring is secured to a second shell for holding contacts in the respective shells engaged, the wave washer is placed under added tension, which is exerted between the engaged stop faces 32b and 34b**.

Since the retainer ring 26 of this invention is fabricated of a metallic material such as aluminum, it is adapted to retain its strength even at elevated temperatures in excess of 200° C. Sawtooth groove patterns or teeth 32 and 34 may each be quickly and easily formed during a single turn on a turning machine eliminating the need for expensive screwthread forming operations. While the advantages of using a metal retaining ring 26 in place of a plastic retaining ring are fairly apparent, it has heretofore not been believed possible to obtain a tight fit between two metal parts with a plurality of interlocking sawtooth groove patterns or teeth because of the limited elasticity or displacement of the metallic material without shearing and the relative stiffness of the parts, for as seen in the drawings, the walls are thick relative the length and radius. However, it has been discovered that by careful selection of the dimensions for the various components, a metal-to-metal mating with sawtooth groove patterns may be achieved utilizing a plurality of teeth on each ring to provide a large bearing area for supporting the load created by the wave washer and ambient forces such as vibration and temperature changes. The teeth on the retaining ring engage closely at both faces with teeth on the coupling ring to limit the axial length required for the teeth and relative movement therebetween.

Referring to FIGS. 2A and 2B, the most critical dimension is the tooth height T. If this height is too low, tooth strength will be reduced. This could lead to a possible shearing of the tooth during stress or, more likely, to the retaining ring compressing and the coupling ring expanding slightly under stress to permit the rings to separate. Thus, for maximum holding, the tooth height should be selected to be at least equal to the sum of the maximum deflections of the two rings under stress without deformation. In practice, the tooth height is selected to be slightly greater than the combined deflections of the two rings resulting in a slightly permanent deformation of at least one of the rings to assure a tight permanent fit of retaining ring 26 in coupling ring 14. However, care must be exercised to assure that the teeth are not too large since this could make insertion of the retaining ring into the coupling ring extremely difficult and could result in excessive deformation or damage to one of the rings.

FIGS. 3A and 3B show the direction of the pressure forces applied to the retainer ring and coupling ring respectively during the mating of these two elements. The maximum pressure $P_2$ which may be applied to the retainer ring without deformation is defined by the following equation (1):

$$P_2 = \frac{\sigma_t}{2}\left(\frac{r_2^2 - r_1^2}{r_2^2}\right) \quad (1)$$

Where $\sigma T$ is the maximum tangential stress limited to the elastic strength of the material.

With a pressure $P_2$ applied to the inside of the coupling ring during assembly, the elastic expansion ($\delta_1$) of the coupling ring in a radial direction is defined by equation (2):

$$\delta_1 = \frac{P_2 r_2}{E}\left[\frac{r_3^2 + r_2^2}{r_3^2 - r_2^2} + \mu\right] \quad (2)$$

Where E is the modulus of elasticity for the material of the coupling ring and $\mu$ is the Poisson's ratio for the material.

The elastic contraction of retainer ring 26 under a pressure $P_2$ during assembly is defined by equation (3):

$$\delta_2 = \frac{P_2 r_2}{E}\left[\frac{r_2^2 + r_1^2}{r_2^2 - r_1^2} - \mu\right] \quad (3)$$

From what has been said above, it is apparent that the minimum height T of each sawtooth should thus be the sum of the elastic expansion and elastic contraction of the rings. Thus, $$T = \delta_1 + \delta_2 \quad (4)$$

and, $r_t$ the radius of the ring with the tooth is $$r_t = r_2 + T = r_2 + \delta_1 \delta_2 \quad (5)$$

The $r_t$ and tooth height determined from equations 4 and 5 above are the minimum height values to obtain a tight fit without any permanent deformation of either ring. As a practical matter, some slight permanent deformation of the rings is desirable in order to assure a tight permanent fit. However, the value of T would not be more than 10% greater than that indicated by equation (4) above.

The tooth angle A between the tooth faces 32a and 34a and the respective ring axis will be determined by the tooth height, the width of the ring and the number of teeth on the ring and the mechanical advantage desired to be secured by camming surface portions or camming faces 32a and 34a in assisting expansion and contraction of the respective rings for displacing the teeth to enable their movement past each other. Too large an angle A will obviously result in shearing the teeth in response to the axial forces between the rings since the load will primarily develop over the small bearing area or volume of the teeth while too small an angle A approaching the coefficient of friction between the materials will require added force to overcome the friction and also require too large a distance between adjacent or successive axially displaced teeth 32 or 34.

It will be seen from the drawings that the teeth on each ring are axially spaced on each ring by a predetermined distance corresponding to the axial length of each tooth. While three teeth are shown for the ring in the FIGS., only two of these teeth are actually corrpesponding teeth on coupling ring 14 with opposite faces 32a and 32b on respective adjacent or successive teeth 34 of the coupling ring, for example, to prevent any axial relative movement between the ringafter the teeth are interlocked. In order to assure optimum retention, at least this number of engaging teeth is desirable. In order to engage the teeth, one tooth on each ring must be moved successively past two teeth on the other ring creating considerable resistance to movement. For an exemplary embodiment with a ring axial length or width W of 0.113 inches, the tooth angle is approximately 23°. Normally, a tooth angle of between 20° and 25° would be acceptable although the angle wil vary to some extent depending on the metallic materials utilized and the size of the rings.

To give specific examples of values which have been found suitable, assume that the material for the coupling ring 14 and retaining ring 26 is aluminum with a maximum tangential stress $6_t$ equal 45,000 PSI, a modulus of elasticity E equals $10\times10^6$ PSI, and a Poisson's ratio $\mu=0.33$. For $r_1=0.25$ and $r_2=0.3165$, the wall thickness of the retaining ring is over 0.06 inches or substantially 1/16 of an inch and is substantially 50% of the length or width W of 0.113 inches and approximately ¼ of the tooth smaller or inner radius of $r_1$. In this case, $\delta_1$ would be 0.001866 inches and $\delta_2$ would be 0.001070 inches and as seen from equations 2 and 3 are dependent on the wall thickness of the respective rings. The calculated $r_t$ would be 0.319 inches. A value of $r_t$ equal 0.325 inches has been found to give satisfactory results. With an $r_1$ of 0.5 inches and an $r_2$ of 0.5775 inches, the wall thickness is over 0.07 inches or over 1/16 of an inch, and is again over 50% of the axial length or width W of 0.113 inches. In this case, $\delta_1$ is computed to be 0.003671 inches and $\delta_2$ to be 0.002169 inches. The calculated $r_t$ would thus be 0.584 inches with an $r_t$ of 0.586 inches being found to give satisfactory results.

By reference to equation 2 and the drawings, it will be seen that the outer or coupling ring is of comparable thickness to axial length in the area of tooth coupling and has corresponding inner and outer radii so that as each successive tooth on one ring is moved past the next tooth on the other ring, the added axial forces or load necessary to provide that added movement would appear to exceed the resistance of the material. The surprising result is the ability of the rings and teeth to accept the interference or interlocking engagement of the plurality of closed teeth having the described relationship in response to their axial movement past each other without substantial permanent deformation of said teeth and rings.

It will also be noted from the nature of the teeth that the teeth are machined in the relatively thick wall rings to provide the stop faces substantially perpendicular to the respective ring axis or at a substantially greater angle to the respective ring axis than the camming faces. If only one tooth were provided, vibration and/or other forces on the relatively small bearing area of stop faces **32*b* and 34*b*** might result in failure to retain the rings engaged or assembled. To avoid this result, a plurality of teeth are provided to thereby distribute the load of such forces across a greater area and ensure retention.

When the rings are assembled, a camming face **32*a* on the retaining ring is placed against a camming face 34*a*** on the coupling ring and one axial force is exerted in one axial direction between the rings to expand the coupling ring and contract the retaining ring successively to move one tooth on each ring successively past a plurality of teeth on the other ring and seat or engage each tooth between a pair of adjacent teeth on the other ring. The stop face on each tooth is then engaged with a stop face on one adjacent tooth of the other ring and a camming face on each tooth is engaged with a camming face on another adjacent tooth on the other ring. The engaged stop faces will obviously resist another substantially greater force in the opposite axial direction to prevent separation of the rings and provide a permanent assembly. The wave washer biases the stop faces against each other and when the coupling ring is engaged with another body or shell, the bias of the washer against the stop faces is increased.

In FIG. 4, a connector assembly is indicated by reference character 100. Connector assembly 100 includes a receptacle assembly 102 and a plug assembly 104 secured together by a coupling ring assembly 106.

Figure 5:
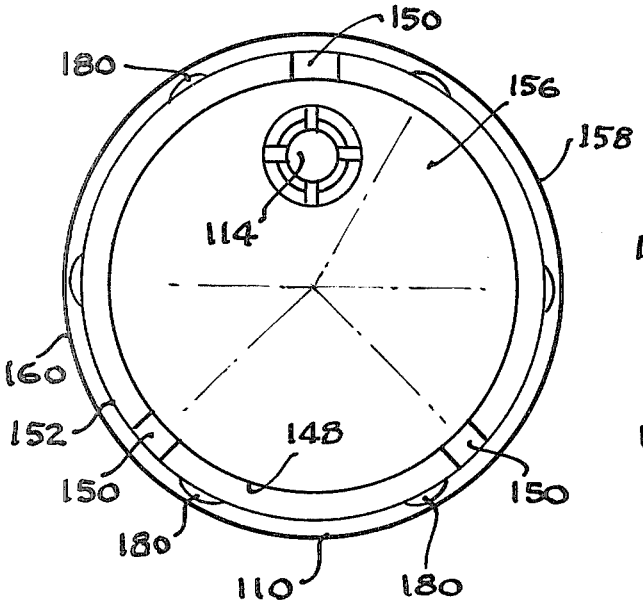
FIG. 5 is a front elevational view of retention disc.
Figure 6:
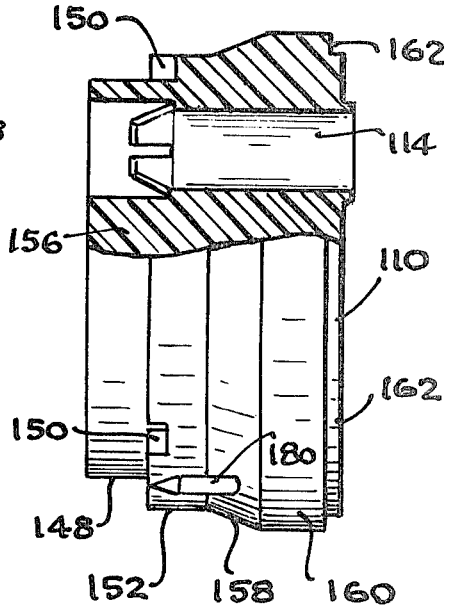
FIG. 6 is a side elevational view of a retention disc partially in section.
Figure 7:
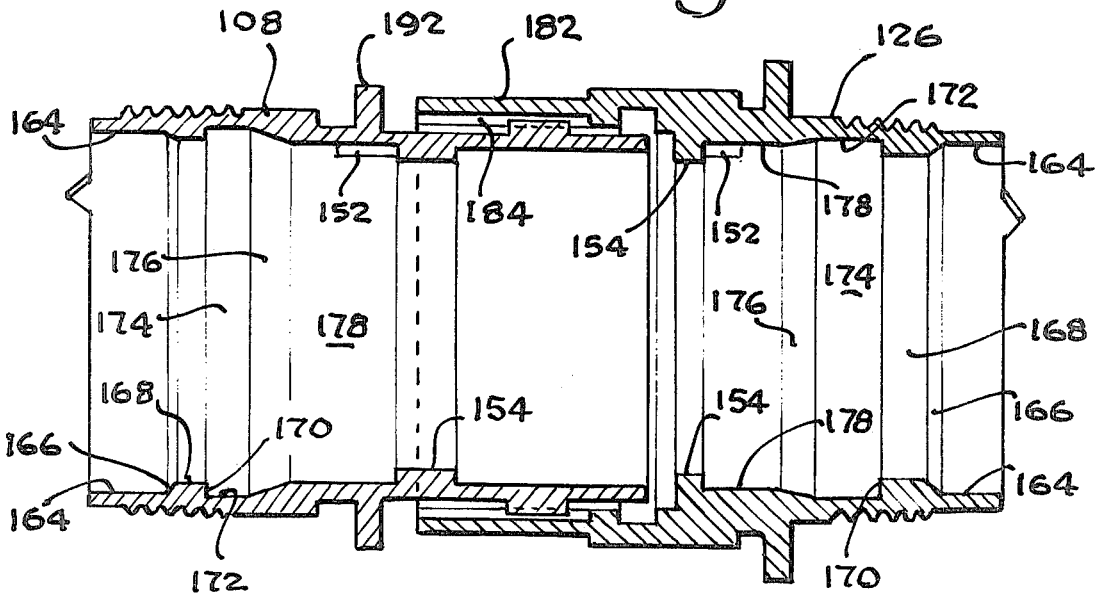
FIG. 7 is a sectional view of the empty shells shown in front-to-front relationship.

The receptacle assembly 102 comprises a generally annular aluminum shell 108 also seen in FIG. 7 in which are located a generally cylindrical retention disc 110 also seen in FIGS. 5 and 6 and a front axially elongated generally cylindrical insert 112 spaced axially adjacent and in front of disc 110. The disc 110 has a plurality of spaced axially extending openings or passageways such as 114 therein each aligned with or registering with a respective identically spaced axial opening or passageway such as 116 in front insert 112 for receiving a respective metal socket contact 118. Contact 118 connects at its rear end to a respective insulated electrical conductor such as 120 extending through a conventional grommet 122 of electrically insulating material. Grommet 122 is located at the rear end of disc 110 and in the rear end of shell 108 with the grommet tightly embracing the conductors under the influence of a nut 124 having conventional means to squeeze the grommet in response to threading on the rear end of shell 108.

The plug assembly 104 comprises a generally annular aluminum shell 126 also seen in FIG. 7 in which are located a generally cylindrical retention disc 128 identical to disc 110 and a generally cylindrical dielectric insert 130 spaced axially adjacent and in front of disc 128 so that the front end of insert 130 spaced from disc 128 faces the front end of insert 112. The disc 128 has a plurality of spaced axially extending openings or passageways such as 132 aligned with or registering with identically spaced axially extending openings or passageways such as 134 in the insert 130 for receiving a respective metal pin contact 136. Each pin contact 136 connects at its rear end to a respective insulated electrical conductor such as 138 extending through a conventional grommet 140 adjacent the rear end of disc 128 and tightly embracing the conductors 138 in response to the threading of a conventional grommet squeezing nut 142 on the rear end of shell 126. The front or other end of each pin contact 136 projects beyond the front end of the insert 130 for engagement in the front or other end of a respective tubular socket contact 116 to electrically connect the respective contacts and conductors 120 and 138.

The discs 110 and 128 and the inserts 112 and 126 are each moulded from a plastic material such as polyarylsulfone capable of withstanding high temperatures and sold by the Minnesota Mining and Manufacturing Company of Minneapolis, Minnesota, under the identification P-360. Contact retention means comprising a plurality of integrally formed circumferentially spaced tines 144 are formed adjacent the front end of each disc 110 and 128. The tines 144 project forwardly toward the respective insert and radially inwardly or toward the respective passageway axis for engaging the rear radial surface of a retaining means or radially outwardly extending flange 146 formed on the respective pin contact or socket contact.

Each insert 112 and 130 has a rear radial or transverse surface engaged with a front radial or transverse surface of the respective disc 110 and 128 and since the passageways in the inserts are of smaller diameter than the disc passageways, the rear radial surfaces of inserts 112 and 130 each forms a stop to engage the front radial surface of each flange 146 for limiting movement of the contact toward the front of the shell. An annular projection formed around each insert passageway 116 and 134 is nestingly engaged in the respective disc passageway to form a high resistance tortuous path for preventing leakage currents between the contacts or the leakage of sealant onto the contacts. An outer or peripheral annular lip is also provided on each insert 112 and 130 projecting axially rearwardly of the respective insert in the direction of the respective disc for engagement in a peripheral annular disc recess 148 formed in the adjacent or front end of each disc to provide a high resistance electrical path to any leakage current from the contacts to the shell.

In addition, each insert lip is provided with rearwardly axially extending circumferentially spaced keys for nesting engagement in a respective axially extending recess 150 formed in the end shoulder of the lip or in one front small diameter portion 152 of the respective disc adjacent peripheral recess 148, as best seen in FIGS. 5 and 6. The insert keys and the engaging disc recesses 150 are angularly spaced and dimensioned or sized so that the inserts and discs must have a predetermined angular orientation to each other to provide proper engagement therebetween. The inserts 112 and 130 also have a radially outwardly extending shoulder in which circumferntially spaced axially rearwardly extending recesses are formed for receiving a respective key 152 on the internal surface of each shell to properly orient the inserts and discs in a predetermined angular orientation relative the shells. The shell keys 152 together with respective adjacent abutments 154 form stops for engaging respective radial faces on the inserts to limit movement of each insert and disc in one axial direction toward the front of the shell. Each insert, however, has a front reduced diameter portion projecting forwardly of the respective shell abutment to permit adjacent positioning of the front end surfaces of the inserts when the shells are secured together.

The discs 110 and 130 each has an axial length of substantially 0.34 inches and the periphery is interconnected generally throughout the disc length by a radially extending continuous web 156. Behind or to the rear of small diameter portion 152, the outer or peripheral surface of each disc 110 and 128 is formed with a radially outwardly and axially rearwardly extending or conical camming surface portion or camming face as indicated at 158 terminating in an enlarged diameter closed peripheral surface portion 160 extending axially toward the disc rear for substantially 1/10 of an inch. The camming surface portion 158 is substantially 0.12 of an inch long and has an angle to the disc axis of between 9° and 11°. Surface portion 160 is continuously interconnected by web 156 and terminates at its rear end in a continuous stop face or stop shoulder 162 extending radially perpendicular to the disc axis.

The internal surface of each shell 108 and 126 has a relatively large internal diameter rear portion 164 in front of which is located a conical camming surface portion or camming face 166 terminating in a closed annular surface portion 168 having an axial length of 0.05 inches and having a reduced diameter less than portion 164 and less than the disc peripheral surface portion 160. Surface portion 166 corresponds in length to disc portion 158 and extends radially outwardly at an angle of 14° to 16° to the shell axis and axially rearwardly from the rear end of reduced diameter portion 168. The reduced diameter closed annular surface portion 168 terminates in a radially outwardly extending continuous stop face or stop shoulder 170 perpendicular to the shell axis and forming the rear end of an enlarged diameter recess 172 in the internal surface of the shell. Recess 172 corresponds in shape and dimension to disc portions 158 and 160 and it has a rear annular surface portion 174 and a radially inwardly and forwardly extending conical surface portion 176 at an angle of 9° to 11° to the shell axis and terminating in a reduced diameter portion 178 at the front end of portion 176.

Shell portion 168 has a diameter which is between 0.011 inches and 0.018 inches smaller than the enlarged diameter portion 160 of the disc with the difference dependent on the nominal sizes of the shells and disc. For example, if portion 160 of disc 112 or 128 has a nominal diameter of 0.488 inches, the internal diameter of shell portion 168 is substantially 0.497 inches so that the difference in diameter is substantially 0.011 of an inch with the shoulder 162 substantially 0.015 of an inch and the shoulder 170 having a radial height of 0.03 of an inch. If disc portion 160 has a nominal diameter of 1.318 inches, shell portion 168 has a nominal diameter of 1.300 inches so that the interfering diameters have a difference of 0.018 of an inch. The shouler 162 in this case has a height of substantially 0.024 of an inch and the shoulder 170 has a height of 0.03 of an inch so that in each case shoulder 170 is larger than the disc shoulder to accommodate any eccentricity in the location of shoulder 162.

The disc camming surface portion 158 engaging the shell camming surface 166 in response to the insertion of the disc through enlarged diameter portion 164 and the application of a selected or one axial force in the appropriate axial direction assists in compressing the disc and expanding the shell without shearing or marring the disc to enable the force fit of the disc past shell portion 168 despite the relative thick or continuous web portion 156 of the disc, until the disc portions 158 and 160 are received or seated in recess 172. When the discs are seated in the respective shell recesses, the stop shoulders 162 and 170 on each disc and recess engage to prevent disassembly or retraction of the discs from the shells under a substantially greater force in the opposite axial direction than that required to assemble the discs in the shells. The force required to disassemble the discs would normally result in shearing the discs.

A plurality of six circumferentially equi- angularly spaced longitudinally extending ribs 180 are provided on the periphery of each disc. Each rib has a rounded periphery and extends longitudinally at substantially the same angle as camming portion 158 from intermediate the axial ends of the camming portion 158 on each disc to an axial position intermediate the axial ends of the disc front surface portion 152 so that the ribs 180 engage the juncture of the shell recess 176 and the reduced diameter surface portion 178 directly in front of recess 172. The ribs 180 serve the important function of maintaining the disc centered and axially aligned with the shell axis.

Shell 126 is provided with a forwardly extending portion 182 projecting substantially beyond the front of insert 130. Portion 182 has an enlarged internal diameter for telescopingly receiving the front end of shell 108. The forwardly extending portion 182 is provided with an internal keyway 184 for receiving an external key on shell 108 to ensure proper angular orientation between the shells. A seal is nestingly received in an internal recess of shell portion 182 for engaging over the front portion of shell 108.

The coupling assembly 106 comprises a coupling ring 186 and a retaining ring 188, which are secured on shell 108. The coupling ring 186, as previously explained, has a rear annular enlarged diameter portion 190 overlapping a radially outwardly extending flange 192 on shell 108 and a series of teeth 194 on the internal surface adjacent the rear end of the ring 186 for a forced interference or interlocking fit with external teeth 196 provided on a retaining ring 182 and to the rear of flange 192, as described in connection with FIGS. 1, 2A and 2B. A spring wave washer 198 is interposed between flange 192 and ring 188 permits limited axial movement of the rings toward the front of shell 108 against the pressure or bias of the washer 198; however, movement toward the rear of shell 108 is limited by the shoulder or stop means 200 on ring 186 engaging flange 192.

The forward or front portion of ring 186 overlaps the telescoping portion 182 of shell 126. Portion 182 has a radially outwardly extending conventional projection or key 202 thereon that fits a conventional cam track in the front portion of ring 186 to secure the shells 108 and 126 together in conventional fashion with the contacts engaged, when the rings 186 and 188 are rotated relative the shells 108 and 126, after the shells are positioned as shown in FIG. 4. It will be appreciated that the ring 186 may at its forward end also be provided with conventional threads for engaging a conventional threaded periphery on the external surface of shell portion 182.

While the invention has been particularly shown and described above with reference to a preferred embodiment thereof, it will be apparent to those skilled in the art that various changes in form and detail may be made therein without departing from the spirit and scope of the invention.

What is claimed is:

1. An electrical connector assembly for establishing electrical connections between each contact of one plurality of contacts carried by insulating means in a first annular shell and a respective contact of another plurality of contacts carried by insulating means in a second annular shell comprising:

a metal coupling ring encircling said first shell with said ring having means adjacent one end of said ring for securing said ring to said second shell with each contact of said one plurality of contacts engaged with a respective contact of the other plurality of contacts;

a first plurality of successive annular closed ring teeth integrally formed on the internal surface of said ring adjacent the other end of said ring with each tooth spaced axially of said ring from each other tooth and having an inner radius and an outer radius, each tooth including a camming face extending from the inner radius toward the other end of the ring and to the outer radius at a first predetermined angle of substantially less than 90° to the axis of said ring, each tooth having a stop face extending radially outwardly of the inner radius of the camming face on the respective tooth at another predetermined angle to said axis substantially greater than said first predetermined angle and located axially on the side of the respective tooth adjacent the one end of said ring;

a metal retaining ring having a second plurality of closed ring teeth integrally formed on the outer periphery of said retaining ring with each tooth on said retaining ring spaced from each other tooth on said retaining ring and having an outer radius substantially equal to the outer radius of each tooth on said coupling ring and an inner radius substantially equal to the inner radius of each tooth on said coupling ring, each tooth on said retaining ring having a camming face extending axially toward one end of said retaining ring and from the outer radius to the inner radius at an acute angle to the axis of said retaining ring, each tooth on said retaining ring having a stop face projecting radially inwardly from the outer radius of the camming face of the respective tooth on said retaining ring to the inner radius at said other greater predetermined angle to the axis of said retaining ring;

the difference between said inner radius and said outer radius dependent on the wall thickness of said retaining ring and said coupling ring for elastically expanding said coupling ring and elastically contracting said retaining ring a distance corresponding to the difference beween said inner radius and said outer radius in response to the engagement of a camming face on one tooth of said retaining ring with a camming face on one tooth of said coupling ring and the application of one axially directed force therebetween to successively move one tooth on each ring in one axial direction relative said coupling ring past a plurality of teeth on the other ring without substantial deformation of the teeth and rings whereby the stop face on each of a plurality of teeth on said retaining ring is each thereafter engaged with a respective stop face on a respective tooth on said coupling ring for preventing movement in another axial direction of the retaining ring relative said coupling ring in response to the application of a force substantially greater than said one force to thereby provide a permanent assembly of said rings; and stop means for holding said shells and rings against axial movement relative each other with said stop means including biasing means for biasing each stop face on said retaining ring in said other axial direction against an engaged stop face on said coupling ring.

2. The electrical connector assembly claimed in claim 1 in which:

said first annular metal shell has an axially extending recess formed in the internal surface of said first shell intermediate the ends of said shell with one axial end of said recess bounded by an integrally formed closed annular surface portion having a small diameter than said recess for forming a continuous radial stop shoulder at the one axial end of said recess;

said insulating means including a cylindrical retention disc of dielectric material formed from a plastic of high compressive modulus having an axially extending continuous peripheral surface portion with a larger diameter than said closed annular surface portion, a continuous radial stop shoulder on said disc terminating one axial end of said continuous peripheral surface portion, a radial web portion continuously interconnecting the periphery surface portion of said disc throughout the axial extent of the periphery surface portion on said disc throughout the axial extent of the peripheral surface portion on said disc and having a plurality of longitudinal passageways therein for carrying said contacts; and means on the periphery of said disc and on the internal surface of said first shell to create a radially inwardly directed force on said disc for radially inwardly compressing said disc in response to the application of a selected axial force to said disc in one axial direction relative said first shell for moving the enlarged diameter peripheral surface portion of said disc through the small diameter annular surface portion of said first shell for seating said enlarged diameter peripheral surface portion on said disc in said recess to relieve said radially inwardly directed force on said disc with the stop shoulder on said disc engaging the stop shoulder on said first shell to prevent movement of said disc in another axial direction relative said first shell in response to a force substantially greater than said selected force to thereby provide a permanent assembly of said first shell and disc.

3. The connector assembly claimed in claim 1 in which the camming face on each tooth has the same angle and said retainer ring has a wall thickness equal to at least 50% of the axial length of said retainer ring and the axial distance between each tooth on said retaining ring is substantially equal to the axial distance between each tooth on said coupling ring whereby each face on each tooth of one ring is engaged with a respective face on adjacent teeth of the other ring.

4. The connector assembly as claimed in claim 3 wherein the difference between said inner radius and said outer radius is substantially 10% greater than the sum of the elastic expansion ($\delta_1$) of the coupling ring defined as $$\delta_1 P_2\, r_2/E[[(r_3^2+r_2^2)/(r_3^2-r_2^2)]+\mu]$$

with $P_2$ being the pressure applied to the rings; $r_2$ being the outer radius of the retainer ring and the inner radius of the coupling ring; $r_3$ being the outer radius of the coupling ring; and E being the modulus of elasticity and $\mu$ being Poisson's ratio for the metal, and the elastic contraction ($\delta_2$) of the retainer ring defined as $$\delta_2=P_2\, r_2/E[[(r_2^2+r_1^2)/(r_2^2-r_1^2)]-\mu]$$

where $r_1$ being the inner radius of the retainer ring, whereby a slight permanent deformation of at least one of said rings is provided for resisting the separation of said coupling ring from said retaining ring.

5. An electrical connector assembly comprising:

a plurality of contacts:

an annular metal shell having a small diameter closed annular portion integrally formed on the internal surface of said shell;

a retention disc of dielectric material formed from a plastic of high compressive and tensile modulus having a closed surface peripheral portion with the diameter of said closed surface peripheral portion larger than the small diameter closed annular portion of said shell, a radial web portion of said disc continuously interconnecting the peripheral surface portion of said disc and having a plurality of longitudinal passageways therein and means removably mounting said contacts in said passageways;

a first cam surface of the internal surface of said shell;

a second cam surface on the periphery of said disc engaging with said first cam surface on the internal surface of said shell to provide a radially inward directed pressure for radially inwardly compressing said disc to enable passage of said larger diameter peripheral surface portion of said disc through the small diameter closed annular portion of said shell in response to the movement of said first cam surface against said second cam surface and the application of one axial force in one direction on said disc;

means for thereafter relieving the radial pressure on said disc in response to the passage of said larger diameter peripheral surface portion of said disc through said small diameter closed annular portion to enable the removal of said contacts while said disc is mounted in said shell; and a respective stop means on said shell and disc engaged in response to the movement of the large diameter peripheral surface portion of said disc through said closed annular portion of said shell for thereafter preventing movement of said disc in the opposite axial direction relative said shell under a force substantially greater than said one axial force to provide a permanent assembly of said disc and shell.

6. The assembly claimed in claim 5 in which said second cam surface comprises a continuous conical camming surface on said disc extending radially inwardly and axially from one end of the peripheral surface portion of said disc, and said first cam surface on said shell comprises a continuous conical camming surface on said shell extending radially outwardly and axially from one end of a small diameter closed annular surface portion of said shell.

7. The assembly claimed in claim 6 in which said respective stop means comprises a continuous shoulder on said disc extending radially inwardly from the large diameter peripheral surface portion of said disc at the axial end opposite the conical camming surface on said disc, and a continuous shoulder on said shell extending radially outwardly of the small diameter closed annular surface portion of said shell at the axial end of said shell opposite the conical camming surface of said shell.

8. The assembly claimed in claim 7 in which the shoulder on said disc has a radial diameter greater than the inner radial diameter of the shoulder on said shell for ensuring continuous circumferential engagement between the shoulders.

9. The assembly claimed in claim 8 in which said means for relieving said radial inward pressure includes an enlarged diameter recess in said shell conforming to the shape and dimension of the large diameter peripheral surface portion and the camming surface on said disc for receiving the large diameter peripheral surface portion and the camming surface on said disc in response to passage of the camming surface and peripheral surface portion on said disc through the small diameter portion of said shell.

10. In the assembly claimed in claim 9, a plurality of circumferentially spaced axially extending ribs projecting from the camming surface on the disc for engaging the internal surface of said shell in response to the engagement of said disc in the recess of said shell for maintaining the axis of said disc aligned with the axis of said shell.

11. In the assembly claimed in claim 10, in which said disc is formed of a high temperature-resistant polyarylsulfone.

12. An electrical connector assembly comprising:

a plurality of contacts;

an annular metal shell having an axially extending recess formed in the internal surface of said shell intermediate the ends of said shell with one axial end of said recess bounded by a first closed annular surface portion integrally formed on said shell having a smaller diameter than said recess and forming a first stop shoulder at said one axial end of said recess;

a cylindrical retention disc of dielectric material formed of plastic of a high compressive and tensile modulus having an axially extending continuous peripheral surface portion with a larger diameter than the closed annular surface portion of said shell, a second stop shoulder terminating one axial end of said continuous conical peripheral surface portion, a radial web portion on said disc continuously interconnecting the peripheral surface portion throughout the axial extent of the peripheral surface portion and having a plurality of longitudinal passageways therein and means removably mounting said contacts;

stop means for preventing movement of said disc in one axial direction of said shell in response to said disc engaging said recess with the shoulder on said disc engaging the stop shoulder on said shell for preventing axial movement of said disc and insert in the opposite axial direction;

a first cam surface on the periphery of said disc extending radially inwardly from the disc surface portion of said larger diameter at an axial position on said disc spaced from said second stop shoulder;

and a second cam surface on the internal surface of said shell and extending radially outwardly from the closed annular surface portion of the shell at an axial position on said shell spaced from said first stop shoulder for engaging the cam surface on said disc to create a radial inward pressure on said disc to radially inwardly compress said disc to enable passage of said larger diameter peripheral surface portion of said disc through the shell surface portion having said small diameter in response to one axial force in said one direction on said disc to engage said disc in said recess and to enable contact removal by relieving said radial inward pressure, said stop shoulder on said disc engaging the stop shoulder at said recess one axial end to hold said disc against movement in the other axial direction relative said shell under a force substantially greater than said one axial force to provide a permanent assembly of said disc and shell.

13. In the connector assembly claimed in claim 12, a front cylindrical insert of dielectric material formed from plastic of a high compressive and tensile modulus having passageways aligned with the passageways of the disc for each receiving a respective contact carried by said disc and having a smaller diameter periphery than said first and second annular surface portions and located intermediate said disc and said stop means for engaging said stop means to limit movement of said disc in said one axial direction, means for holding said insert in a predetermined angular position relative said disc and shell and stop means adjacent each insert passageway for holding the respective contact received in the insert passageway against movement in said one axial direction.

14. The assembly claimed in claim 12 in which said first cam surface on the periphery of said disc comprises a conical camming surface portion on said disc extending radially inwardly of said peripheral surface portion of said disc and axially from the other end of the peripheral surface portion of said disc, and said second cam surface comprises a conical camming surface portion on said shell extending radially outwardly of the small diameter closed annular shell portion and from the axial end of said closed annular surface portion opposite said recess and said means removably mounting said contacts includes resilient fingers in each contact passageway extending radially inwardly of the respective passageway to engage a respective contact carried in the passageway for holding the respective contact against movement in said opposite axial direction.

15. In the assembly claimed in claim 14, a conical surface portion in said recess for receiving the conical camming surface portion on said disc and terminating in a second small internal diameter annular surface portion on said shell, and a plurality of circumferentially spaced longitudinally extending ribs extending from the conical camming surface portion on said disc for engaging spaced positions along the juncture of the conical surface portion in the recess and the second small diameter portion for maintaining the disc axially aligned with said shell.

16. An electrical connector assembly for establishing an electrical connection between each contact of a plurality of contacts and another contact of another plurality of contacts comprising:

a pair of annular metal shells each having a front end and a rear end, a respective disc receiving recess of enlarged diameter in the internl surface of each shell located intermediate the front end and rear end of the respective shell, each said recess having a conical surface extending radially inwardly and axially forwardly from intermediate opposite axial ends of the respective recess, and a first reduced diameter internal closed annular surface portion for each shell adjacent the rear end of the respective recess, a stop shoulder formed at the rear end of each recess by the respective first reduced diameter closed annular surface portion with each stop shoulder perpendicular to the axis of the respective shell, each first reduced diameter surface portion terminating in a continuous conical camming surface portion extending rearwardly and radially outwardly of the respective first reduced diameter portion, a second reduced diameter portion in each shell extending axially forwardly of the continuous conical surface portion of the respective recess;

a plurality of contacts for each shell;

a retention disc for each shell removably mounting a respective plurality of contacts, each disc formed from a plastic material of a high compressive and tensile modulus and having a front end and a rear end with an enlarged outer diameter continuous peripheral surface portion extending axially from adjacent the rear end of each disc, a continuous conical camming surface portion on each disc extending radiallly inwardly and axially forwardly of the respective continuous peripheral surface portion with each disc continuous peripheral surface portion and camming surface portion conforming in dimension and shape to a respective shell recess for receipt in the respective shell recess, a radial web for each disc continuously interconnecting the respective peripheral surface portion and the conical camming surface portion of the respective disc, each disc conical camming surface portion engaging the conical camming surface portion of the respective shell for exerting a contracting radially inwardly directed force on each disc in response to one axial force in a respective one axial direction on the respective disc for moving the respective disc past the first reduced diameter closed annular portion of the respective shell for receipt in the respective shell recess to relieve the radially inwardly directed force on the respective disc to enable contact removal with said disc mounted in said shell, and a rear radial stop shoulder on each disc extending perpendicular to the disc axis for engaging the stop shoulder at the rear of a respective recess for preventing movement of each disc in a respective other axial direction and disengagement of said disc from said recess in response to a force in the respective opposite axial direction and substantially greater than said one axial force to provide a permanent assembly of each shell and a respective disc;

a plurality of circumferentially spaced ribs extending forwardly on each disc and radially outwardly of the conical surface portion of each disc from one axial position intermediate the ends of each disc conical surface portion to an axial position adjacent the front end of each disc for engaging the juncture of each recess conical surface portion with the respective second reduced diameter surface portion to hold the respective disc seated in the respective recess coincident with the axis of the respective shell; and a plurality of passageways extending axially through each disc including means removably mounting said plurality of contacts, each of said contacts adapted to engage with a respective contact carried by the disc in the other shell.

17. An electrical connector assembly comprising:

an annular metal shell having opposite shell ends with one small diameter closed annular portion integrally formed on the internal surface of said shell intermediate said shell ends, a first stop shoulder extending radially outwardly from said closed annular portion substantially perpendicular to the axis of said shell at one axial end of said closed annular portion, a recess in the internal surface of said shell extending axially from said shoulder toward one shell axial end and located intermediate said shell ends, a closed annular camming surface portion integrally formed on the internal surface of said shell adjacent the other axial end of said closed annular portion and extending radially outwardly of said closed annular portion and axially from said closed annular portion toward the other axial end of said shell;

a plurality of contacts;

a retention disc of dielectric material formed from a plastic of a high compressive and tensile modulus having a closed surface peripheral portion with the diameter of said closed surface peripheral portion larger than the small diameter closed annular portion of said shell and adapted to engage in said recessed portion, a continuous radial web extending from the closed surface peripheral portion of said disc and between opposite axial ends of said disc, a plurality of axially extending passageways formed in said web, means removably mounting said contacts in said passageways, a stop shoulder extending radially inwardly of said closed surface peripheral portion substantially perpendicular to the axis of said disc at one axial end of said closed surface peripheral portion and adapted to engage against the stop shoulder at one axial end of said closed annular portion in response to the engagement of said closed surface peripheral portion in said recess, a camming surface portion on said disc extending radially inwardly of said closed surface peripheral portion and axially from the other end of said closed surface peripheral portion for engaging the camming surface portion of said shell to exert a radially inwardly directed pressure on said disc to compress said disc for enabling passage of said disc through said small diameter closed annular portion in response to one force on said disc in one axial direction relative said shell whereafter said disc is engaged in said recess to relieve said radially inwardly directed pressure to enable contact removal with said disc mounted in said shell;

a metal coupling ring encircling said shell;

a first plurality of successive annular closed ring teeth integrally formed on the internal surface of said ring adjacent the one end of said ring with each tooth spaced axially of said ring from each other tooth by a predetermined distance and having an inner radius and an outer radius, each tooth including a camming face extending from the inner radius toward the one end of the ring and to the outer radius at a first predetermined angle of substantially less than 90° the axis of said ring, each tooth having a stop face extending radially outwardly of the inner radius of the camming face on the respective tooth at another predetermined angle to the axis of said ring substantially greater than said first predetermined angle and located axially on the side of the respective tooth adjacent the one end of said one ring;

a metal retaining ring having a second plurality of closed ring teeth integrally formed on the outer periphery of said retaining ring with each tooth on said retaining ring spaced from each other tooth on said retaining ring by said predetermined distance and having an outer radius substantially equal to the outer radius of each tooth of said coupling ring and an inner radius substantially equal to the inner radius of each tooth on said coupling ring, each tooth having a camming face extending axially toward one end of said retaining ring and from the outer radius to the inner radius at said first predetermined angle to the axis of said retaining ring, each tooth on said retaining ring having a stop face projecting radially inwardly from the outer radius of the camming face of the respective tooth on said retaining ring to the inner radius at said other predetermined angle to the axis of said retaining ring the difference between said inner radius and said outer radius dependent on the wall thickness of said retaining ring and said coupling ring for elastically expanding said coupling ring and elastically contracting said retaining ring a distance corresponding to the difference between said inner radius and said outer radius in response to the engagement of a camming face on one tooth of said retaining ring with a camming face on one tooth of said coupling ring and the application of an axial force therebetween to successively move one tooth on each ring in one axial direction past a plurality of teeth on the other ring without substantial deformation of the teeth and rings whereby the stop face on each of a plurality of teeth on said retaining ring is each engaged with a respective stop face on a respective tooth on said coupling ring for thereafter preventing movement in another axial direction of the retaining ring relative said coupling ring in response to the application of a force greater than said one force in said other axial direction; and stop means for holding said rings and shell against axial movement relative to each other with said stop means including biasing means for biasing each stop face on said retaining ring in said other axial direction against an engaged stop face on said coupling ring.

18. An electrical connector assembly comprising:

a plurality of contacts;

an annular metal shell having a small diameter closed annular portion integrally formed on the internal surface of said shell;

a retention disc of dielectric material formed from a plastic of high compressive and tensile modulus having a closed peripheral surface portion with the diameter of said closed peripheral surface portion larger than the small diameter closed annular portion of said shell, a radial web portion of said disc continuously interconnecting the peripheral surface portion of said disc and having a plurality of longitudinal passageways therein and means removably mounting said contacts in said passageways;

a first cam surface of the internal surface of said shell;

a second cam surface on the periphery of said disc engaging with said first cam surface on the internal surface of said shell to provide a radially inwardly directed pressure for radially inwardly compressing said disc to enable passage of said larger diameter peripheral surface portion of said disc through the small diameter closed annular portion of said shell in response to the movement of said first cam surface against said second cam surface and the application of one axial force in one direction on said disc;

a plurality of circumferentially spaced axially extending ribs projecting from said cam surface on said disc for engaging the internal surface of said shell in response to the engagement of said disc in the recess of said shell for maintaining the axis of said disc aligned with the axis of said shell;

means for relieving the radial pressure on said disc in response to the passage of said larger diameter peripheral surface portion of said disc through said small diameter closed annular portion to enable the removal of said contacts while said disc is mounted in said shell; and a respective stop means on said shell and disc engaged in response to the movement of the large diameter peripheral surface portion of said disc through said closed annular portion of said shell for thereafter preventing movement of said disc in the opposite axial direction relative said shell under a force substantially greater than said one axial force to provide a permanent assembly of said disc and shell.

19. An electrical connector assembly comprising:

a plurality of contacts;

a hollow metal shell having a small dimension closed portion integrally formed on the internal surface of said shell;

a retention member of dielectric material formed from a plastic of high compressive and tensile modulus having a closed surface peripheral portion with a dimension of said closed surface peripheral portion larger than the small dimension portion of said shell, a web portion of said retention member continuously interconnecting the peripheral surface portion of said retention member and having a plurality of longitudinal passageways therein and means removably mounting said contacts in said passageways;

a first cam surface on the internal surface of said shell;

a second cam surface on the periphery of said retention member engaging with said first cam surface on the internal surface of said shell to provide an inwardly directed pressure for inwardly compressing said retention member to enable passage of said larger dimension peripheral surface portion of said retention member through the small dimension portion of said shell in response to the movement of said first cam surface against said second cam surface and the application of one axial force in one direction on said retention member;

a plurality of axially extending ribs disposed about said retention member and projecting from the camming surface on said retention member for engaging the internal surface of said shell in response to the engagement of said retention member in the recess of said shell for maintaining the axis of said retention member aligned with the axis of said shell;

means for relieving the inwardly directed pressure on said retention member in response to the passage of said larger dimension peripheral surface portion of said retention member through said small dimension portion of said shell to enable the removal of said contacts while said retention member is mounted in said shell; and a respective stop means on said shell and retention member engaged in response to the movement of the large dimension peripheral surface portion of said retention member through said small dimension portion of said shell for thereafter preventing movement of said retention member in the opposite axial direction relative said shell under a force substantially greater than said one axial force to provide a permanent assembly of said retention member and said shell.

20. An electrical connector assembly comprising:

an annular metal shell including first and second radially extending and axially spaced shoulders integrally formed in the internal surface of said shell to define a recess, and a conical camming surface integrally formed on the internal surface of said shell and extending both radially inwardly and axially toward said second shoulder, said second shoulder defining a first internal diameter of said shell;

a retention disc of dielectric material formed of plastic of a high compressive and tensile nodulus, said disc including longitudinal passageways there-through, means for removably mounting said contacts in said passageways, a first stop surface for engaging said first shoulder in said recess to prevent axial movement of said disc in one axial direction, a second stop surface for engaging said second shoulder to prevent axial movement of said disc in the opposite axial direction, a first peripheral surface portion having a second diameter larger than said first diameter, a conical second peripheral surface portion adjacent said first surface portion for engaging said camming surface on said shell as said disc is moved axially toward said first stop shoulder to create a radially inwardly directed pressure on said disc to radially inwardly compress said disc and enable passage of said second diameter periheral surface portion through said smaller first diameter of said shell in response to an axial force on said disc in said one direction.

a plurality of circumferentially spaced longitudinally extending ribs extending from said conical surface portion for engaging spaced positions along the juncture of the camming surface and the first diameter shoulder on the internal surface of said shell for maintaining said disc axially aligned with said shell; and means, including said recess, for relieving the radially inwardly directed pressure on said disc to enable contact removal as said second stop surface is moved into axial alignment with said second stop shoulder.

* * * * *